US012096861B2

(12) United States Patent
Shao

(10) Patent No.: US 12,096,861 B2
(45) Date of Patent: Sep. 24, 2024

(54) FOLDABLE METAL FRAME SOFA

(71) Applicant: NINGBO UNION GRAND IMP AND EXP CO., LTD., Ningbo (CN)

(72) Inventor: Jiyin Shao, Ningbo (CN)

(73) Assignee: NINGBO UNION GRAND IMP AND EXP CO., LTD., Ningbo (CN)

( * ) Notice: Subject to any disclaimer, the term of this patent is extended or adjusted under 35 U.S.C. 154(b) by 82 days.

(21) Appl. No.: 17/979,852

(22) Filed: Nov. 3, 2022

(65) Prior Publication Data

US 2024/0148148 A1 May 9, 2024

(51) Int. Cl.
*A47C 4/42* (2006.01)
*A47C 17/04* (2006.01)

(52) U.S. Cl.
CPC ..... *A47C 4/42* (2013.01); *A47C 17/04* (2013.01)

(58) Field of Classification Search
CPC ..... A47C 4/42; A47C 17/04
See application file for complete search history.

(56) References Cited

U.S. PATENT DOCUMENTS 8,894,138 B2 * 11/2014 Monahan ..... A47C 7/407 297/44
2021/0153658 A1 * 5/2021 Kim ..... A47C 17/04
2021/0267378 A1 * 9/2021 Ozturk ..... A47C 17/165
2022/0346561 A1 * 11/2022 Wang ..... A47C 4/028

* cited by examiner

*Primary Examiner* — Mark R Wendell
(74) *Attorney, Agent, or Firm* — Daniel M. Cohn; Howard M. Cohn

(57) ABSTRACT

A foldable metal frame sofa includes a metal frame, a seat cushion, a back cushion and two armrests. The metal frame includes a seat frame, a backrest frame and a front baffle. The backrest frame is detachably mounted on a rear edge of the seat frame and is foldable with respect to the seat frame. The front baffle is foldably mounted on a front edge of the seat frame with respect to the seat frame. The seat cushion is removably disposed on the seat frame. The back cushion is removably disposed on the backrest frame. The two armrests are respectively located at a left side and a right side of the metal frame, and each of the two armrests is detachably mounted and connected to an end portion of the seat frame and an end portion of the backrest frame.

6 Claims, 1 Drawing Sheet

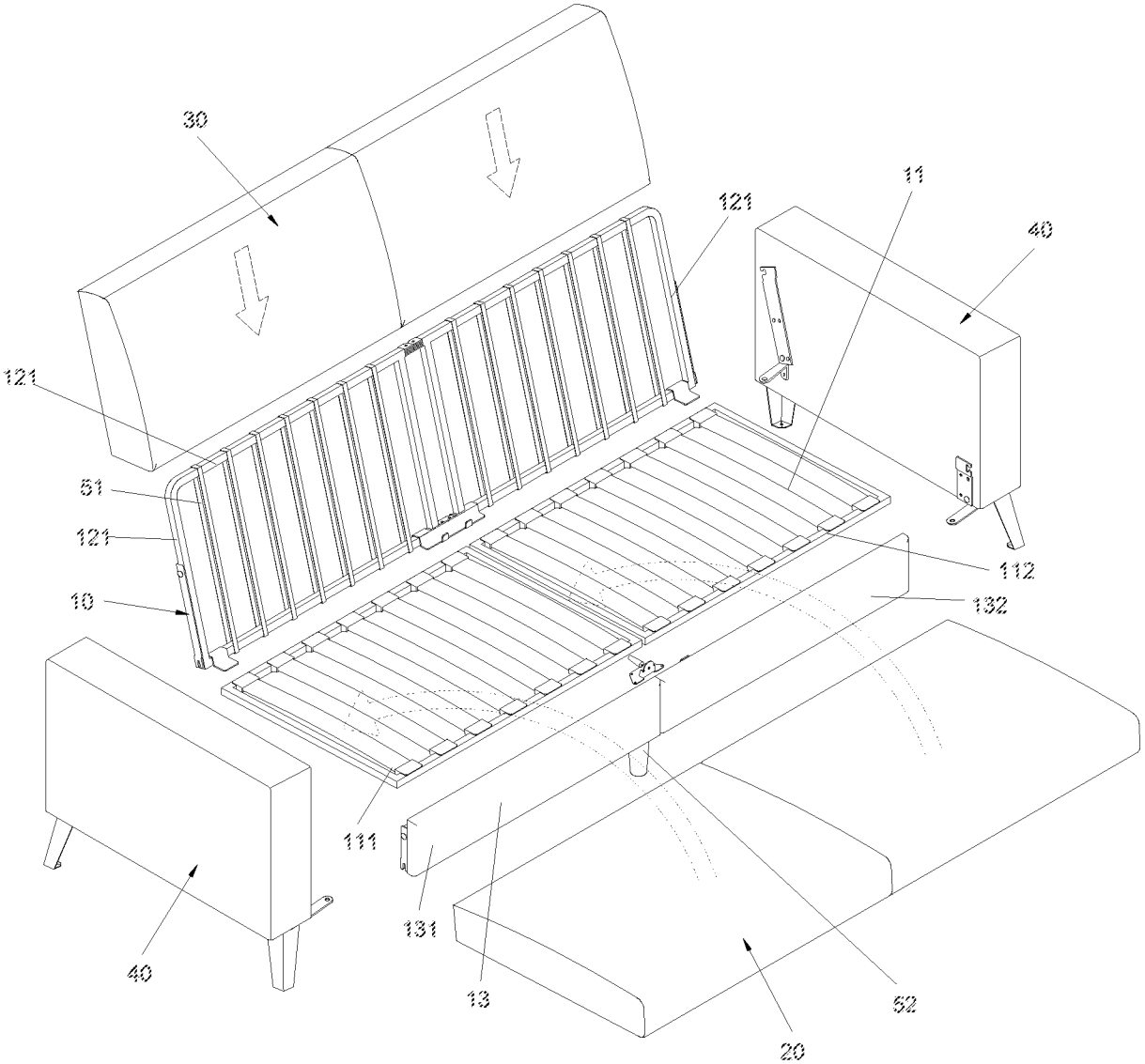
40
11
121
30
121
51
121
10
112
132
52
20
13
131
111
40

FOLDABLE METAL FRAME SOFA

TECHNICAL FIELD

The present disclosure relates to a technical filed of furniture, in particular to a foldable metal frame sofa.

BACKGROUND

In China, "Sofa" is a foreign word transliterated from the English word sofa and refers to a multi-seat chair equipped with sofa cushions, and also refers to a backrest chair equipped with springs or thick foam plastics, etc., with armrests on both sides, which is one kind of soft furniture. The origin of the sofa can be traced back to ancient Egypt around 2000 B.C., but real upholstered sofa appeared in the late sixteenth and early seventeenth centuries.

At present, most sofas on the market have wooden frames, whose disadvantages includes that the one-piece wooden back panel and front baffle are of great volumes, and each module is installed with a latch, which is inconvenient for packaging and transportation in the e-commerce industry; backrests of the conventional wooden sofas are hollow inside and will dent after a long time use; and backboards of the conventional wooden sofas are basically vertical to the ground, leading to bad user experience. Therefore, it is necessary to modify the current sofas.

SUMMARY

In view of this, the present disclosure aims at the deficiencies in the prior arts, and a main purpose of the present disclosure is to provide a foldable metal frame sofa, which can effectively solve the problems in the current sofas of being great volumes and inconvenient for packaging and transportation.

To achieve the above aims, the present disclosure adopts the following technical schemes:

A foldable metal frame sofa includes a metal frame, a seat cushion, a back cushion and two armrests, wherein the metal frame includes a seat frame, a backrest frame and a front baffle, the backrest frame is detachably mounted on a rear edge of the seat frame and is foldable with respect to the seat frame, the front baffle is foldably mounted on a front edge of the seat frame with respect to the seat frame, the seat cushion is removably disposed on the seat frame, the two armrests are respectively located at a left side and a right side of the metal frame, and each of the two armrests is detachably mounted and connected to an end portion of the seat frame and an end portion of the backrest frame.

Furthermore, the seat frame includes a left frame body and a right frame body, the left frame body and the right frame body are rectangular, and the left frame body and the right frame body are foldable with respect to each other.

Furthermore, the backrest frame is rectangular and includes two U-shaped rods opposite to each other, and the two U-shaped rods are foldably hinged to each other.

Furthermore, a plurality of elastic bands is disposed on a middle portion of the backrest frame, the plurality of the elastic bands is arranged at intervals along a length direction of the backrest frame, and each of the plurality of the elastic bands extends from up to down.

Furthermore, the front baffle is rectangular and includes a left panel and a right panel, and the left panel and the right panel are foldably hinged to each other.

Furthermore, a foot is disposed at a middle portion of the front baffle.

Compared with the prior arts, the present disclosure has obvious advantages and beneficial effects. Specifically, it can be known from the above technical schemes that:

By using the metal frame, compared with wooden frames, volumes of frames can be greatly reduced. The backrest frame and the front baffle are foldable, which makes it possible to replace the wooden frames with the metal frame under the premise of retaining stability and rigidity to the greatest extent, and a package volume of the foldable metal frame sofa is greatly reduced, which brings convenience for packaging and transportation.

BRIEF DESCRIPTION OF DRAWINGS

FIG. 1 is an exploded schematic view according to one embodiment of the present disclosure.

DESCRIPTION OF REFERENCE NUMBER

10—metal frame, 11—seat frame
111—left frame body, 112—right frame body
12—backrest frame, 121—U-shaped rod
13—front baffle, 131—left panel
132—right panel, 20—seat cushion
30—back cushion, 40—armrest
51—elastic band, 52—foot DETAILED DESCRIPTION Please refer to FIG. 1, a foldable metal frame sofa according to one embodiment of the present disclosure includes a metal frame 10, a seat cushion 20, a back cushion 30, and two armrests 40.

The metal frame 10 includes a seat frame 11, a backrest frame 12 and a front baffle 13. The seat frame 11 includes a left frame body 111 and a right frame body 112. The left frame body 111 and the right frame body 112 are rectangular, and the left frame body 111 and the right frame body 112 are foldable with respect to each other. The backrest frame 12 is detachably mounted on a rear edge of the seat frame 11 and is foldable with respect to the seat frame 11. In the embodiment, the backrest frame 12 is rectangular and includes two U-shaped rods 121 opposite to each other, and the two U-shaped rods 121 are foldably hinged to each other. Furthermore, a plurality of elastic bands 51 is disposed on a middle portion of the backrest frame 12, the plurality of the elastic bands 51 is arranged at intervals along a length direction of the backrest frame 12, and each of the plurality of the elastic bands 51 extends from up to down to avoid a hollow in the backrest frame 12, which ensures even stress and avoids denting. The front baffle 13 is foldably mounted on a front edge of the seat frame 12 with respect to the seat frame 12. The front baffle 13 is rectangular and includes a left panel 131 and a right panel 132, and the left panel 131 and the right panel 132 are foldably hinged to each other. Moreover, a foot 13 is disposed at a middle portion of the front baffle.

The seat cushion 20 is removably disposed on the seat frame 11. In the embodiment, the foldable metal frame sofa includes two seat cushions 20 respectively disposed on a left side and a right side thereof. The back cushion 30 is removably disposed on the seat frame 12. In the embodiment, the foldable metal frame sofa includes two back cushions 30 respectively disposed on a left side and a right side thereof.

The two armrests 40 are respectively located at a left side and a right side of the metal frame 10, and each of the two armrests 40 is detachably mounted and connected to an end portion of the seat frame 11 and an end portion of the backrest frame 12.

An assembly process of the foldable metal frame sofa according to the embodiment is described in detail as follows:

First, screws on bottom portions at a left side and a right side of the backrest frame 12 are locked into J-shaped holes defined at lower parts of rear slide rails of the two armrests 40 at the same time, after the backrest frame 12 and the front baffle 13 are unfolded. After the screws are tightened at the same time, screws on top portions at the left side and the right side of the backrest frame 12 are pushed into C-shaped holes defined at upper parts of the rear slide rails of the armrests 40. After the screws are tightened, the backrest frame 12 is pushed downward to completely lock the four screws at bottom ends of the C-shaped holes. And L-shaped iron sheets are mounted to stabilize the backrest frame 12 and the two armrests 40, and the screws are tightened to complete the installation of the backrest frame 12. The front baffle 13 is installed in the same way in four J-shaped holes defined in front portions of the two armrests 40 and is firmly locked downward, and strip-shaped iron sheets that stabilize the front baffle 13 and the two armrests 40 are installed, and the screws are tightened to complete the installation of the two foldable parts.

Three S-shaped iron blocks are disposed at a bottom of the backrest frame 12, the three S-shaped iron blocks are engaged into and limited in openings defined at a rear side of the seat frame 11, and a front part of the seat frame 11 is placed on a step portion at an upper part of the front baffle 13 to complete the installation of the seat frame 11. The S-shaped iron blocks will be forced downward to connect the backrest frame 12 and the seat frame 11 more firmly during use; bar-shaped iron blocks at four corners of a bottom of the seat frame 11 and L-shaped iron blocks are connected to the four corners and the armrests 40, so that when the sofa is in use, the whole sofa will not shake left and right under downward force and make the screws locked more tightly, and the foot 52 stabilizes the whole sofa.

The present disclosure focuses on that by using the metal frame, compared with wooden frames, volumes of frames can be greatly reduced. The backrest frame and the front baffle are foldable, which makes it possible to replace the wooden frames with the metal frame under the premise of retaining stability and rigidity to the greatest extent, and a package volume of the foldable metal frame sofa is greatly reduced, which brings convenience for packaging and transportation.

The technical principle of the present disclosure has been described above with reference to the specific embodiments. These descriptions are only for explaining the principle of the present disclosure, but should not be construed as limiting the protection scope of the present disclosure in any way. On the basis of the explanation given here, those skilled in this field can associate other specific implementations of the present disclosure without creative labor, and all these implementations should also fall within the protection scope of the present disclosure.

What is claimed is:

1. A foldable metal frame sofa, comprising:
a metal frame;
a seat cushion;
a back cushion; and
two armrests;
wherein the metal frame comprises a seat frame, a backrest frame and a front baffle; the backrest frame is detachably mounted on a rear edge of the seat frame and is foldable with respect to the seat frame, the front baffle is foldably mounted on a front edge of the seat frame with respect to the seat frame; the seat cushion is removably disposed on the seat frame, the two armrests are respectively located at a left side and a right side of the metal frame, and each of the two armrests is detachably mounted and connected to an end portion of the seat frame and an end portion of the backrest frame;
wherein the backrest frame is rectangular and includes two U-shaped rods opposite to each other, and the two U-shaped rods are foldably hinged to each other.

2. The foldable metal frame sofa according to claim 1, wherein the seat frame comprises a left frame body and a right frame body, the left frame body and the right frame body are rectangular, and the left frame body and the right frame body are foldable with respect to each other.

3. The foldable metal frame sofa according to claim 1, wherein a plurality of elastic bands is disposed on a middle portion of the backrest frame, the plurality of the elastic bands is arranged at intervals along a length direction of the backrest frame, and each of the plurality of the elastic bands extends from up to down.

4. The foldable metal frame sofa according to claim 1, wherein the front baffle is rectangular and includes a left panel and a right panel, and the left panel and the right panel are foldably hinged to each other.

5. The foldable metal frame sofa according to claim 1, wherein a foot is disposed at a middle portion of the front baffle.

6. A foldable metal frame sofa, comprising:
a metal frame;
a seat cushion;
a back cushion; and
two armrests;
wherein the metal frame comprises a seat frame, a backrest frame and a front baffle; the backrest frame is detachably mounted on a rear edge of the seat frame and is foldable with respect to the seat frame, the front baffle is foldably mounted on a front edge of the seat frame with respect to the seat frame; the seat cushion is removably disposed on the seat frame, the two armrests are respectively located at a left side and a right side of the metal frame, and each of the two armrests is detachably mounted and connected to an end portion of the seat frame and an end portion of the backrest frame;
wherein a foot is disposed at a middle portion of the front baffle.

* * * * *